US006599150B1

(12) United States Patent
Martin et al.

(10) Patent No.: US 6,599,150 B1
(45) Date of Patent: Jul. 29, 2003

(54) ELECTRICAL CONNECTOR ASSEMBLY

(75) Inventors: Galen M. Martin, Camp Hill, PA (US); Hurley C. Moll, Jr., Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 12 days.

(21) Appl. No.: 10/104,144

(22) Filed: Mar. 22, 2002

(51) Int. Cl.[7] ..... H01R 13/436
(52) U.S. Cl. ..... 439/595
(58) Field of Search ..... 439/595, 752

(56) References Cited

U.S. PATENT DOCUMENTS

| | | | | | |
|---|---|---|---|---|---|
| 5,885,105 | A | * | 3/1999 | Takagishi et al. | 439/595 |
| 6,045,404 | A | * | 4/2000 | Myer | 439/595 |
| 6,126,484 | A | * | 10/2000 | Klein et al. | 439/595 |
| 6,152,768 | A | * | 11/2000 | Beugnot et al. | 439/595 |
| 6,186,813 | B1 | * | 2/2001 | Tomita et al. | 439/595 |
| 6,244,910 | B1 | * | 6/2001 | Grubbs | 439/595 |
| 6,270,376 | B1 | * | 8/2001 | Fink et al. | 439/595 |

* cited by examiner

*Primary Examiner*—Gary Paumen

(57) ABSTRACT

An electrical connector assembly comprising includes a housing having a plurality of terminal receiving passages. Each terminal passage has an opening configured to permit an electrical terminal to be inserted into the passage and a deflectable latch for securing the terminal within the passage. A terminal position assurance device (TPA) is matable with the housing for movement between a partially engaged position and a fully engaged position. The TPA defines an overstress features that cooperates with the latches when the TPA is at its preset position to prevent the latches from deflecting beyond a predetermined point as the terminals are inserted into and/or removed from the passages. The overstress features may include wedge members that are insertable into the housing at locations adjacent the latches. The terminal passages may be arranged in adjacent pairs. In this configuration, the housing includes a longitudinal gap extending between the terminal latches of given pair of adjacent passages. Each wedge member is position for insertion into one of the longitudinal gaps. The wedge member has a reduced sized distal portion which mates with the longitudinal gap when the TPA is at its partially engaged position to limit the deflection of the latches as the terminals are inserted into the passages. The wedge member also includes an increased size proximal portion that biases the associated latches inwardly in their respective passages when the TPA is moved to its fully engaged position, thereby locking the terminals into the passages.

14 Claims, 12 Drawing Sheets

ELECTRICAL CONNECTOR ASSEMBLY

BACKGROUND OF THE INVENTION

In a conventional electrical connector, a housing includes a front end, a rear end and a plurality of terminal receiving passages extending between the front and rear ends. Terminals, such as female contact terminals, are inserted into the rear ends of the passages. Each passage includes a latch that deflects outwardly in the passage to allow the terminal to be inserted into the passage. Once the terminal is fully inserted into the passage, the latch flexes inwardly to lock the terminal into the passage.

Known electrical connectors include terminal position assurance devices (TPA) that mate with the connector housing for movement between a partially engaged position and a fully engaged position. The TPA presents wedges that extend into the plug housing at locations adjacent the terminal passages. When the TPA is at its partially engaged position, the wedges are fully withdrawn from the latches so the latches can flex outwardly sufficiently to permit the terminals to be inserted into the passages. When the TPA is moved to its fully engaged position, the wedges slide into positions underlying the latches, so as to bias the latches inwardly in order to retain the terminals in the passages. In order to prevent overflexing of the latches, the housing typically includes overstress features that limit outward deflection of the latches as the terminals are inserted into the housing and/or during removal of the terminals from the housing. Typically, these overstress features are in the form of separate walls or members formed on the housing at locations adjacent to the latches.

The quest to make electronic devices ever more compact has sparked a related desire to produce compact electrical connectors. Space is at a premium on these electrical connectors. Thus the ability to shrink, eliminate, or increase the efficiency of any component is highly desirable. However, forming the overstress features integrally with the housing increases the overall size of the connector.

A need remains for improved connector assemblies that overcome the problems discussed above. The preferred embodiments of the present invention described below address the above discussed needs and other disadvantages of conventional connector devices that will become readily apparent from the following description, drawings and claims.

BRIEF SUMMARY OF THE INVENTION

According to certain aspects of an embodiment of the present invention, an electrical connector assembly includes a housing having a plurality of terminal receiving passages. Each terminal passage has an opening configured to permit an electrical terminal to be inserted into the passage and a deflectable latch for securing the terminal within the passage. A terminal position assurance device (TPA) is matable with the housing for movement between a preset position and a fully engaged position. The TPA defines an overstress features that cooperates with the latches when the TPA is at its preset position to prevent the latches from deflecting beyond a predetermined point as the terminals are inserted into and/or removed from the passages. The overstress features may include wedge members that are insertable into the housing at locations adjacent the latches.

In one embodiment, each wedge member is configured to serve as an overstress feature for two adjacent latches. In this embodiment, the terminal passages are arranged in adjacent pairs. The housing includes a longitudinal gap extending between the terminal latches in a given pair of passages. The wedge member has a portion which mates with the longitudinal gap when the TPA is at its preset position to limit the deflection of the latches as the terminals are inserted into and/or removed from the passages.

Figure 1:
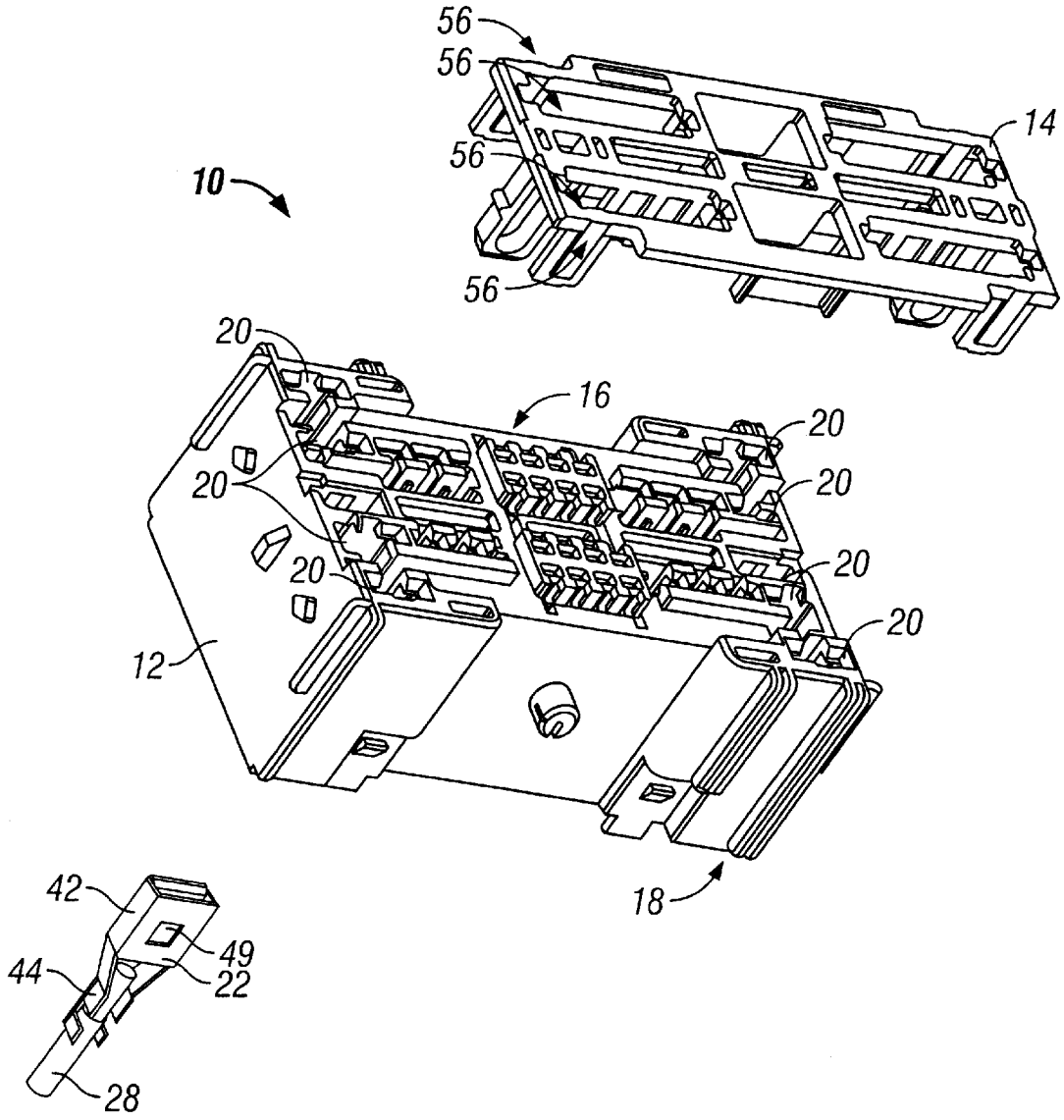
FIG. 1 is an exploded front perspective view of a electrical connector assembly according to certain aspects of an embodiment of the present invention.

The foregoing summary, as well as the following detailed description of the preferred embodiments of the present invention, will be better understood when read in conjunction with the appended drawings. For the purpose of illustrating the preferred embodiments of the present invention, there is shown in the drawings, embodiments which are presently preferred. It should be understood, however, that the present invention is not limited to the arrangements and instrumentality shown in the attached drawings.

DETAILED DESCRIPTION OF THE INVENTION

Figure 2:
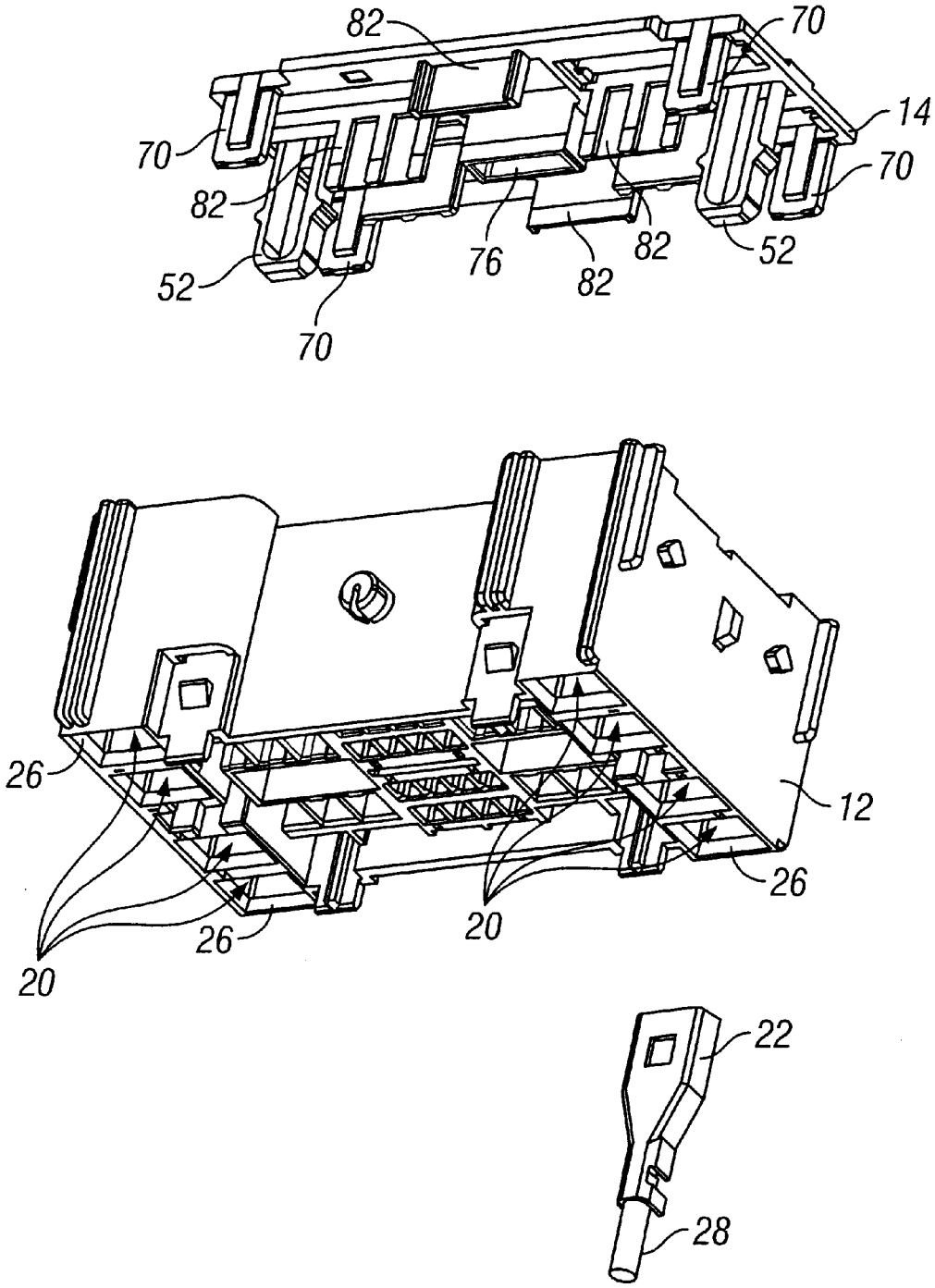
FIG. 2 is an exploded rear perspective view of the electrical connector assembly of FIG. 1.

Referring now to FIGS. 1 and 2, an electrical connector 10 constructed in accordance with certain aspects of the present invention includes a housing 12 and a terminal position assurance device (TPA) 14 configured to mate with the housing. The electrical connector 10 may, for example, be in the form of a plug configured to mate with a receptacle (not shown), as is well known in the art. The housing 12 has a front or mating end 16 (see, e.g., FIG. 5) and a rear end 18 (see, e.g., FIG. 6).

Terminal receiving passages 20 extend between the front and rear ends 16, 18 of the housing 12. Each passage 20 is configured to receive and support an electrical contact terminal 22 within the housing 12. The passages 20 present front openings 24, which are arranged in a predetermined pattern to allow the terminals 22 to mate with the reciprocal terminals (not shown) carried by another connector (not shown), such as a receptacle. The passages 20 also include rear openings 26, which are configured to allow the terminals 22 to be inserted into the housing 12 during assembly of the connector 10, as is explained in greater detail below. Conductors 28, such as wires from a wiring harness or another device (not shown), are connected to the rear ends of the terminals 22 and extend from the rear openings in the housing.

Figure 5:
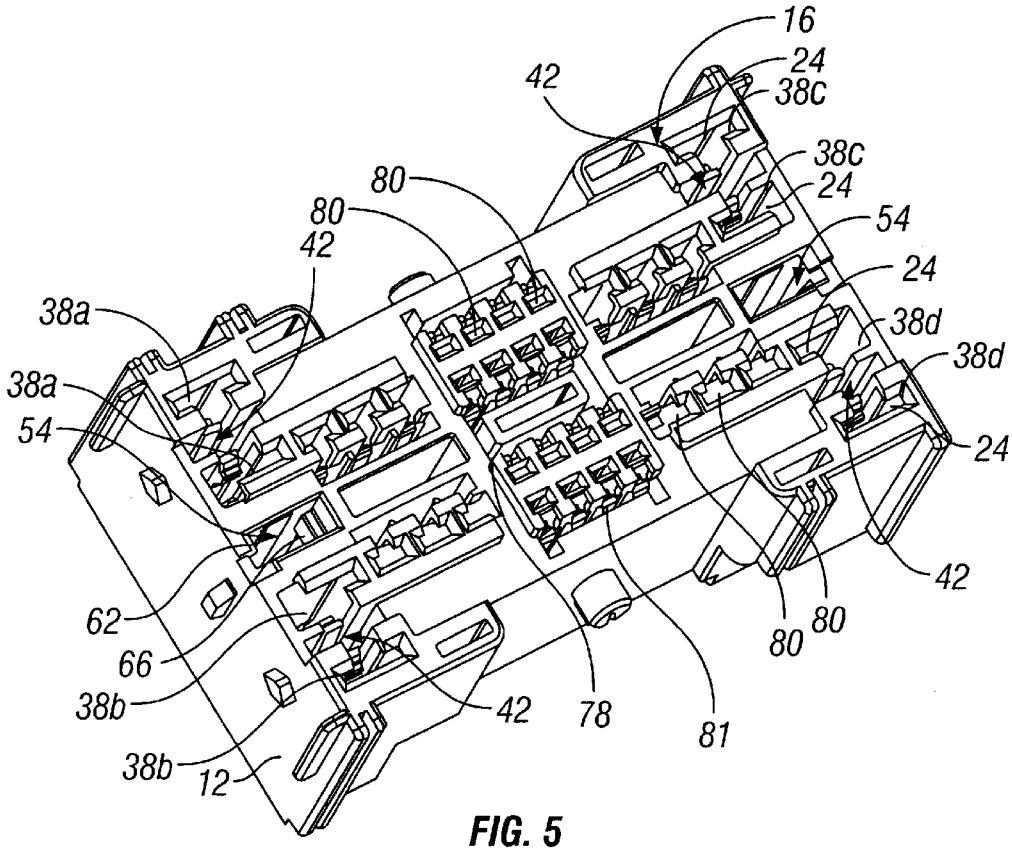
FIG. 5 is front perspective view of the housing from the connector assembly of FIG. 1.
Figure 6:
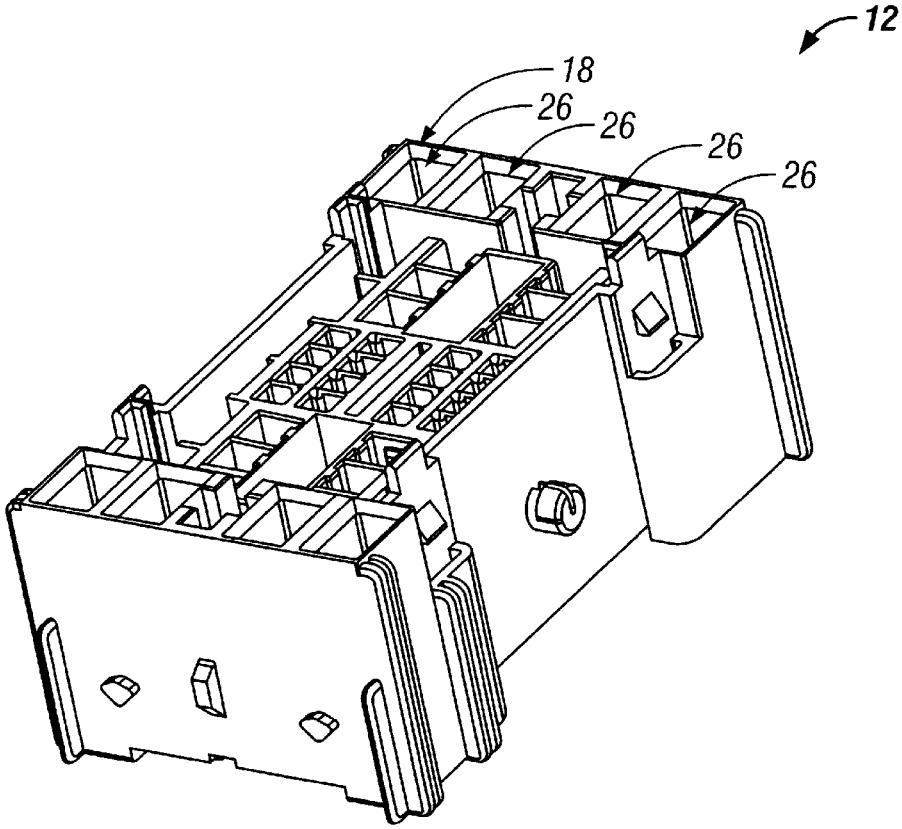
FIG. 6 is a rear perspective view of the housing of FIG. 5.
Figure 7:
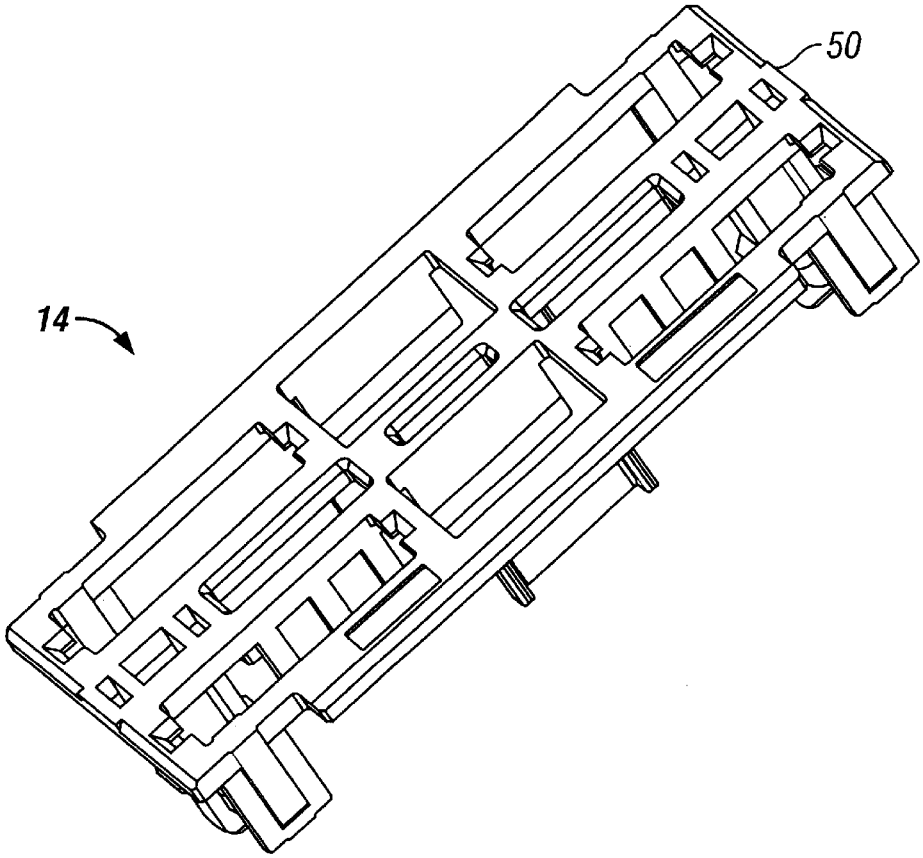
FIG. 7 is a front perspective view of a TPA from the connector assembly of FIG. 1.
Figure 9:
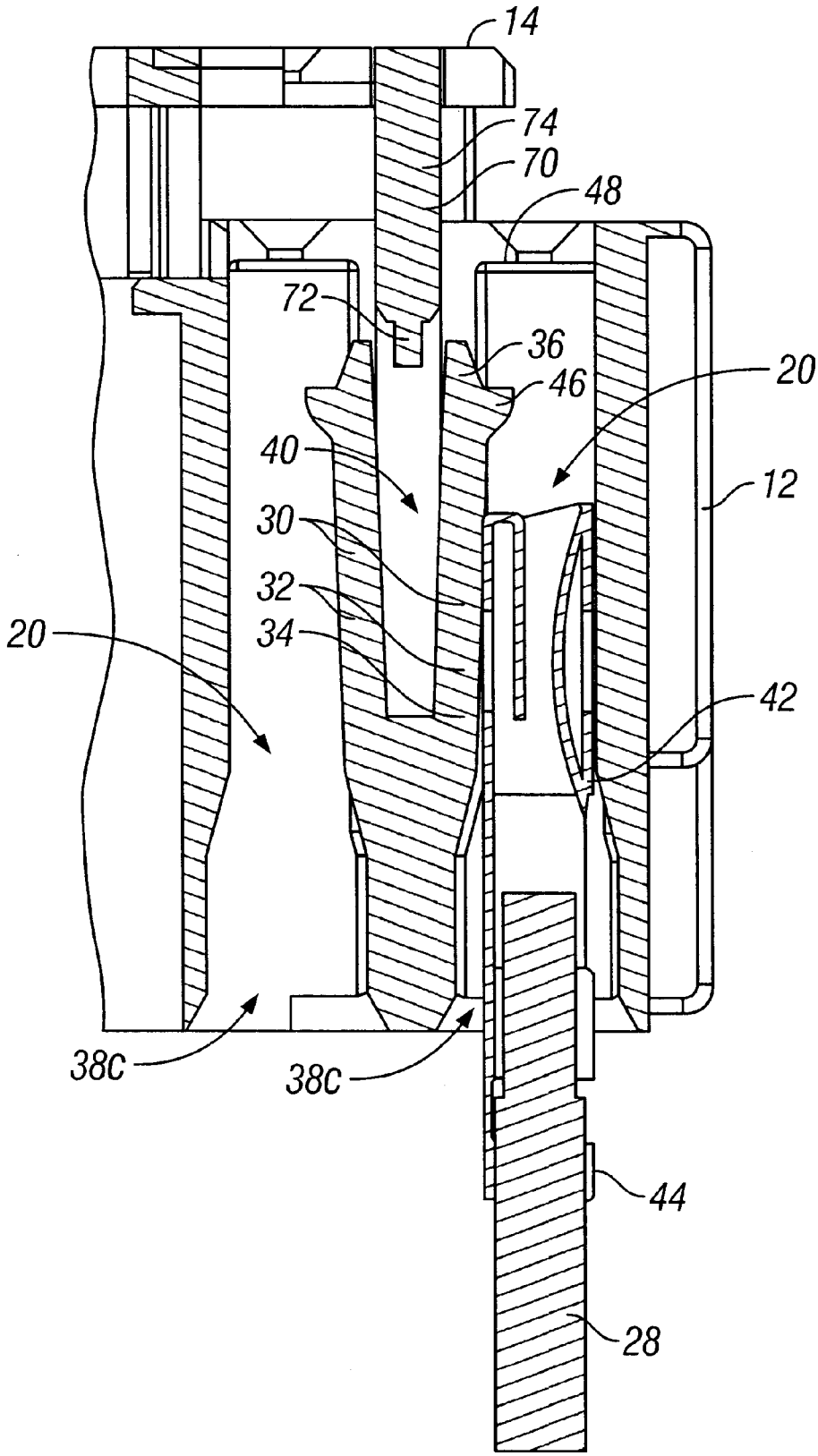
FIG. 9 is a cross-section view of the connector assembly along line A—A of FIG. 4, but showing the TPA at is preset position and an electrical terminal partially inserted into the housing.
Figure 10:
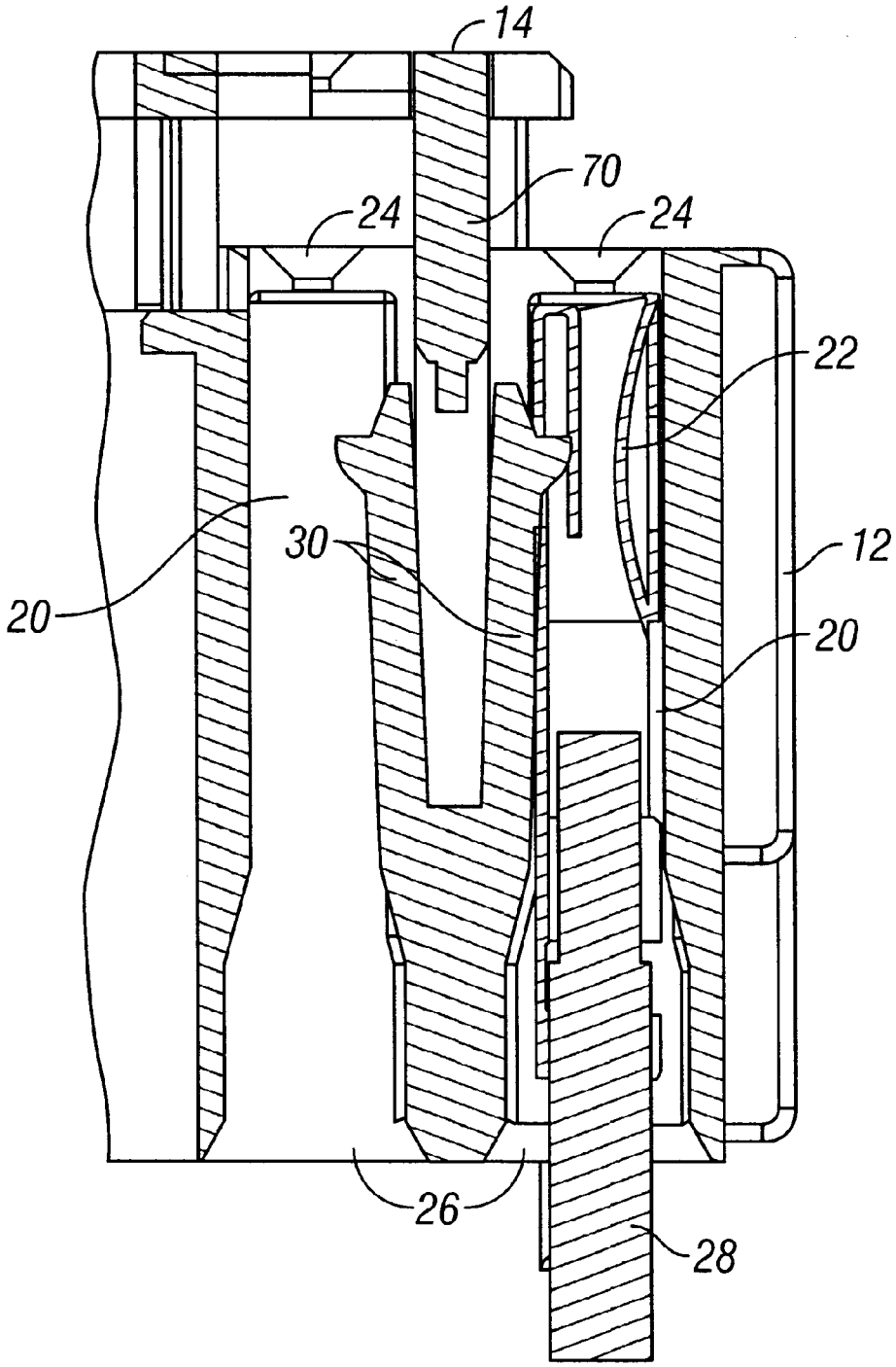
FIG. 10 is a cross-sectional view similar to FIG. 9, but showing the terminal fully inserted into the housing.
Figure 11:
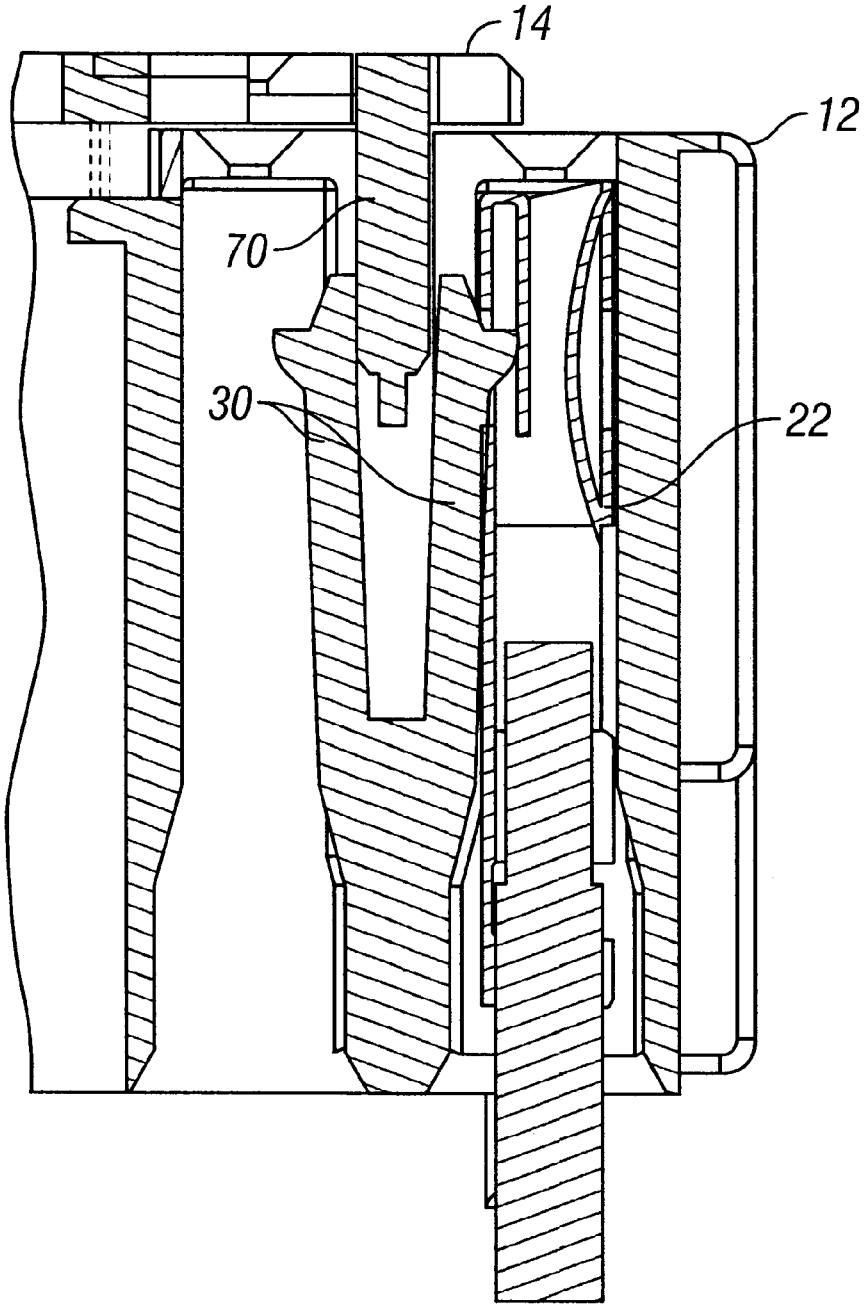
FIG. 11 is a cross-sectional view similar to FIG. 10, but showing the TPA at its fully engaged position.

Referring to FIGS. 9–11, each passage 20 includes a terminal latch 30 for securing a terminal 22 within the passage 20. The terminal latch 30 includes an arm or beam 32 extending longitudinally within a respective passage 20. The beam 32 has a rear end 34 connected to housing 12 and front, free standing end 36 which can be pivoted outwardly in the passage 20 to allow a terminal 22 to be inserted into the passage 20. In the illustrated embodiment, the terminal passages 20 are arranged in adjacent pairs. As can be seen in FIG. 5, the illustrated connector includes eight (8) terminal passages 20, which are arranged in four (4) adjacent pairs 38*a*–38*d*. The terminal latches 30 for a given pair of passages, e.g. the pair 38*c*, are positioned adjacent to one another, as is shown in FIGS. 9–11. In the illustrated embodiment, the adjacent latches 30 are integrally formed with each other and they take the form of a bifurcated latching member. Alternatively, the adjacent latches could be formed separately from each other. A longitudinal gap 40 extends between the beams 32 of the adjacent terminal latches and terminates in an opening 42 (see FIG. 5) in the front of the housing.

During assembly, the terminals 22, which have previously been secured to the conductors 28, are inserted into the passages 20 through the rear openings 26. As can be seen in FIG. 1, each of the terminals 22 includes a front portion 42, which is configured to receive a reciprocal contact, such as a pin from another connector. Each terminal 22 also includes a rear portion 44, which is configured to be secured to one of the conductors 28. As the terminal 22 is inserted into the passages 20, the front portion 42 of the terminal 22 engages against the inner face of latch beam 32. The inner face of the latch beam 32 may be beveled as shown to ease insertion of the terminal 22 into the passage 20. Continued inward movement of the terminal 22 biases the latch beam 32 laterally outwardly in the passage 20. The terminal 22 continues to move longitudinally inwardly into the passage 20 until its front portion 42 moves past a locking finger 46 formed on the front end 36 of the latch beam 32. Once the front portion 42 of the terminal 22 moves beyond the locking finger 46, the latch beam 32 springs laterally inwardly in the passage 20 to secure the terminal 22 within the passage, as is shown in FIG. 10. The terminal 22 is restrained in the passage 22 between the locking finger 46 and a protrusion 48 formed on the front end of the passage 20. The terminal 22 may include an opening 49 (see FIG. 1) configured to receive the locking finger 46.

Figure 3:
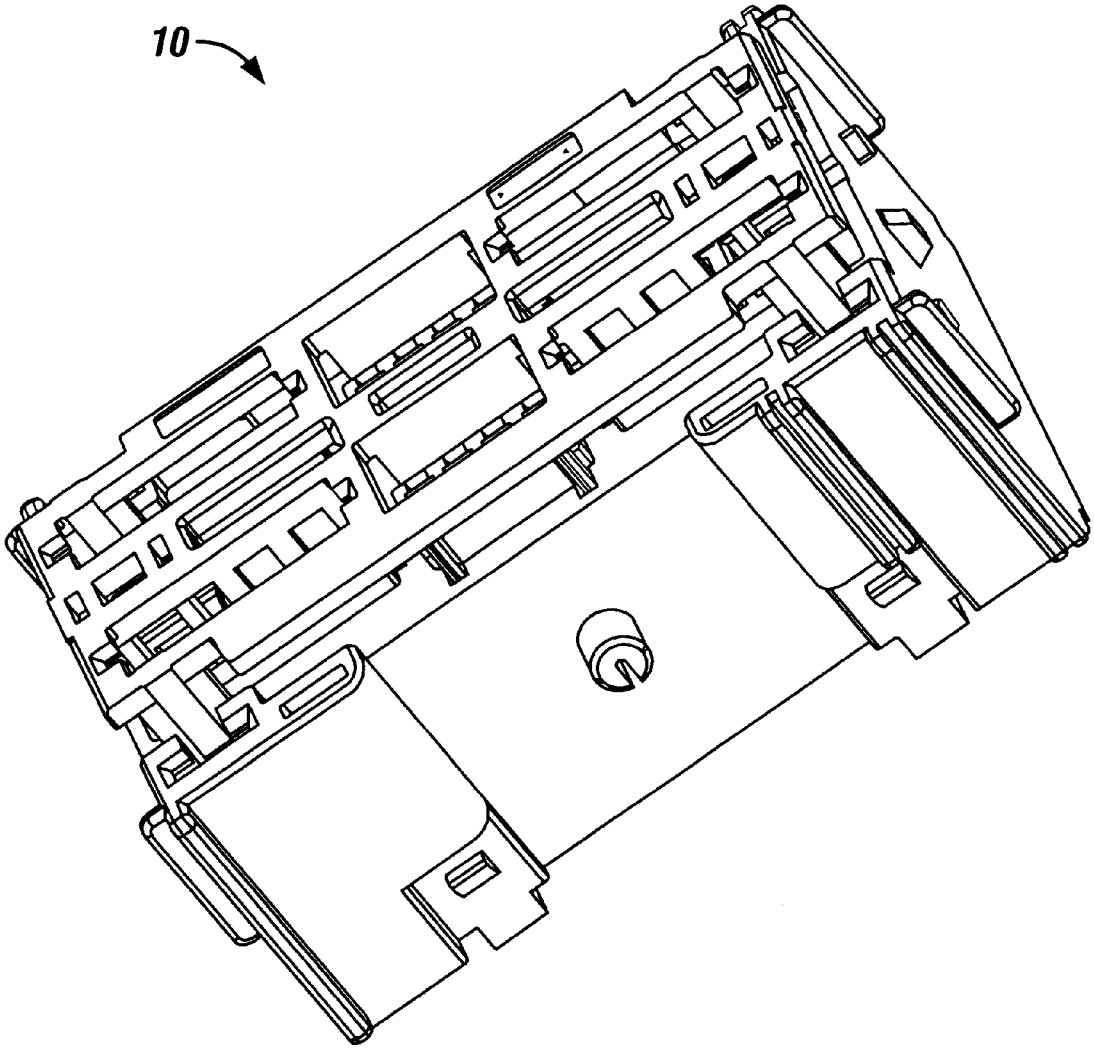
FIG. 3 is front perspective view of the connector assembly of FIG. 1 showing the TPA at its partially engaged position.
Figure 4:
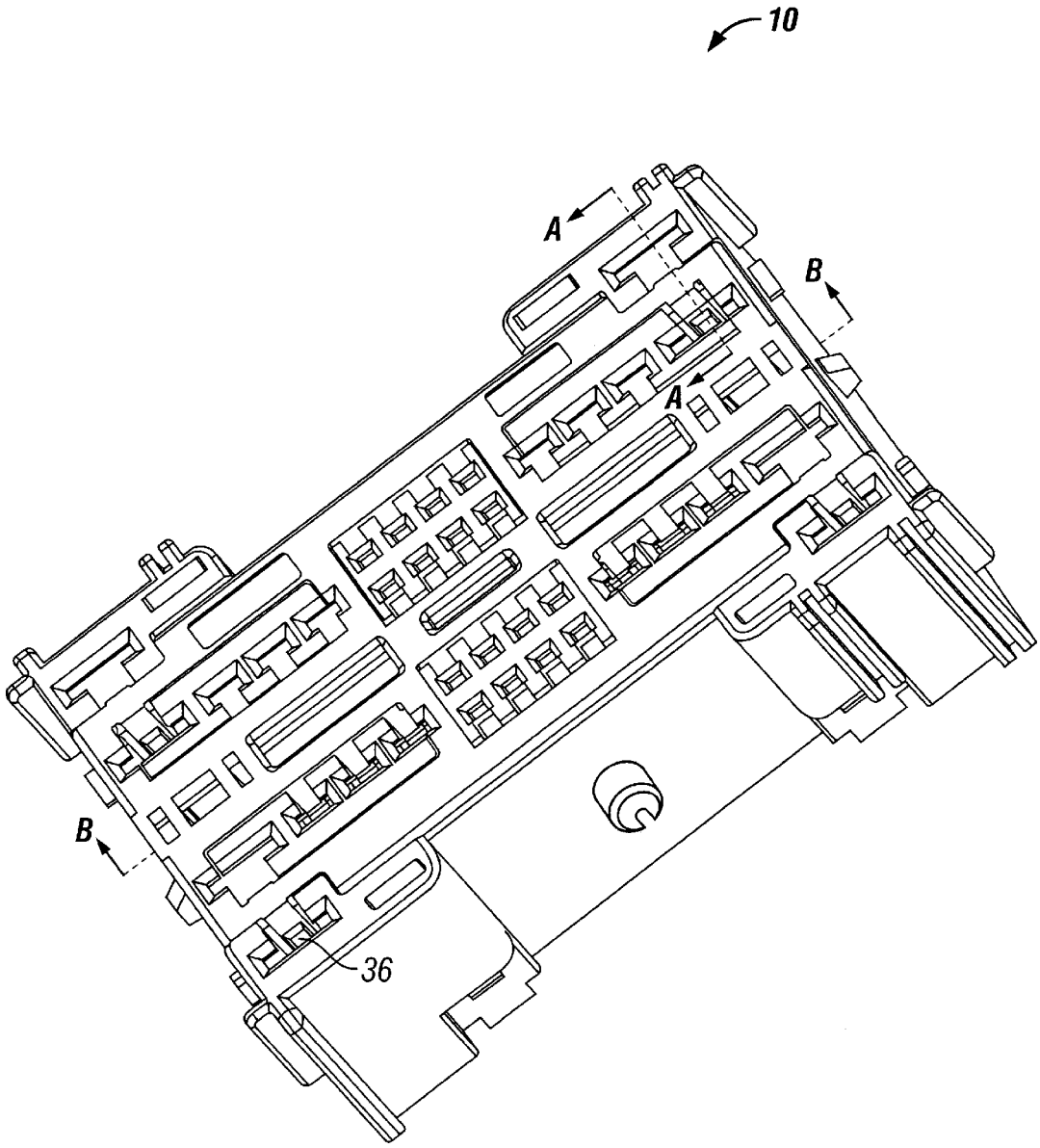
FIG. 4 is front perspective view of the connector assembly of FIG. 1, showing the TPA at its fully engaged position.
Figure 8:
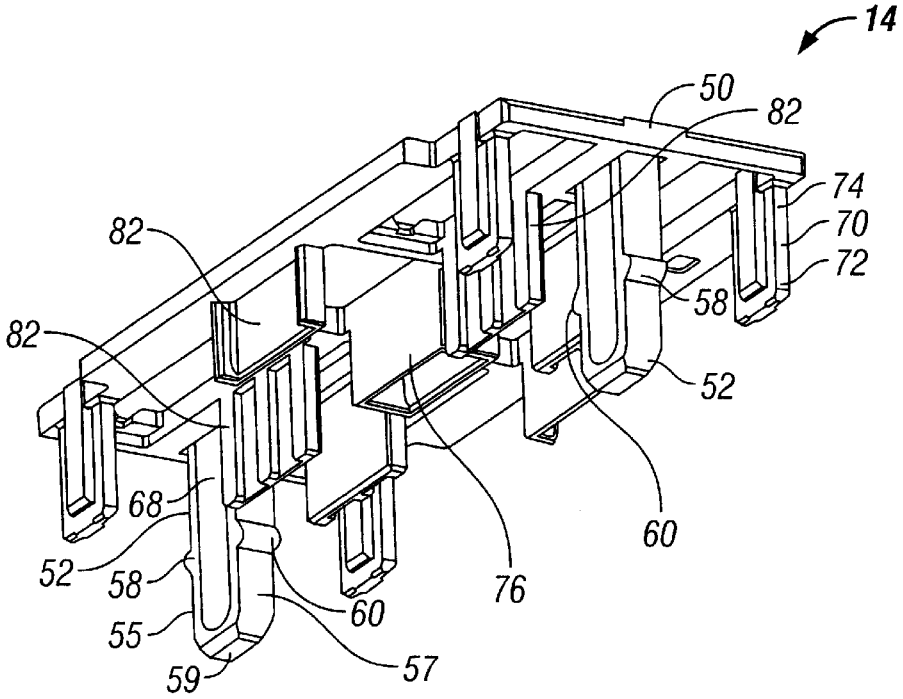
FIG. 8 is a rear perspective view of the TPA of FIG. 7.
Figure 12:
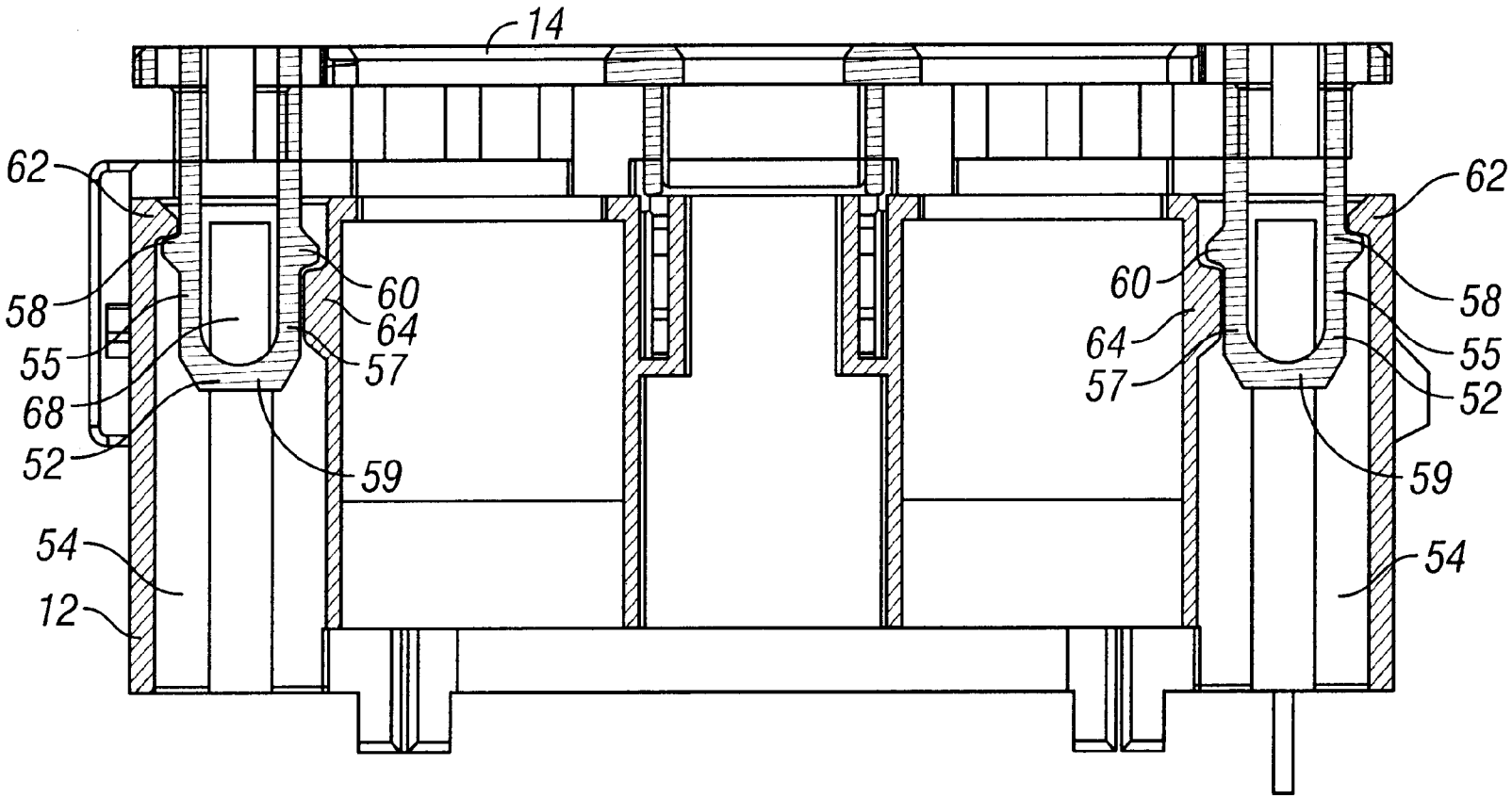
FIG. 12 is a cross-section view along line B—B of FIG. 4, but showing the TPA at its preset position.
Figure 13:
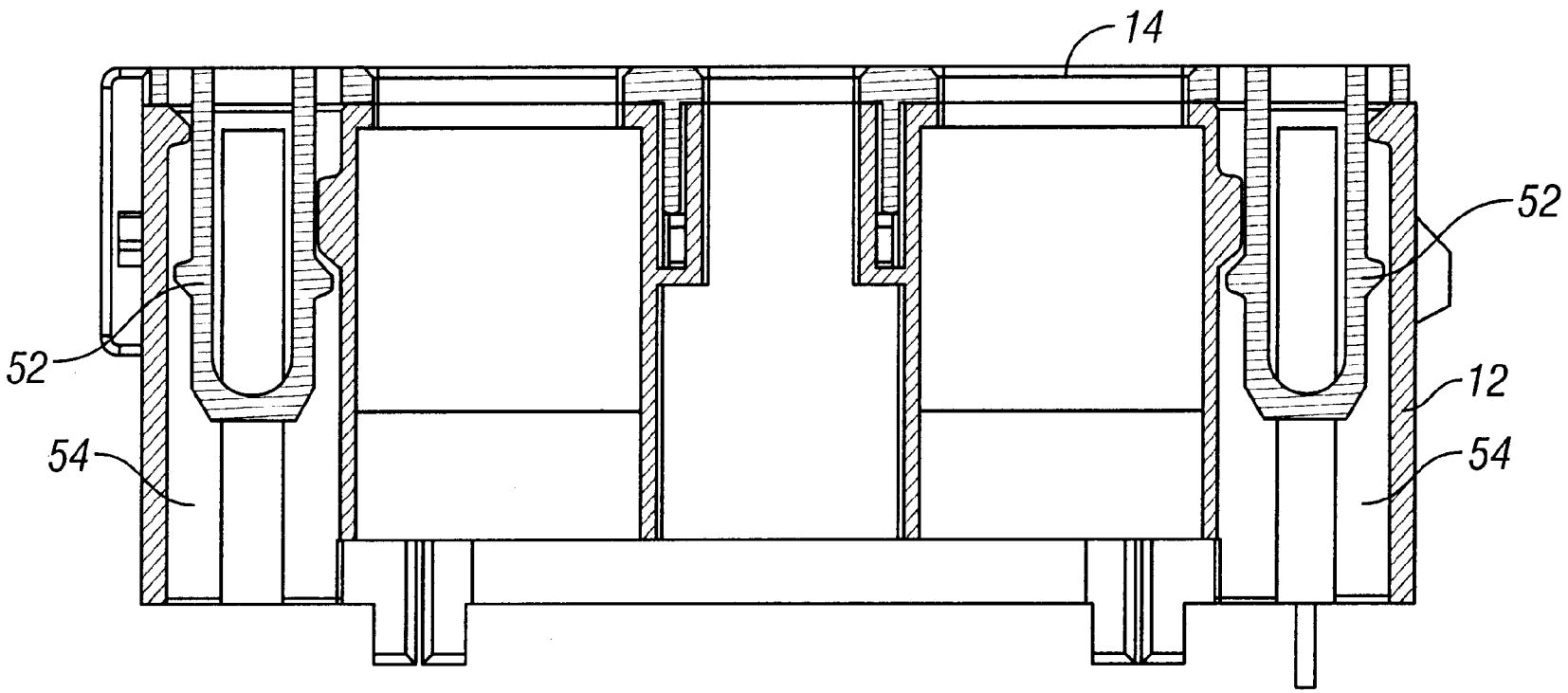
FIG. 13 is a cross-sectional view similar to FIG. 12, but showing the TPA at its fully engaged position.

The TPA 14 is movably connectable on the housing 12 between a first or preset position (see FIGS. 3, 9 and 12) and a second or fully engaged position (see FIGS. 4, 11 and 13). For this purpose, the TPA 14 includes a pair of latching members 52, which extend from the front wall 50 of the TPA. (See FIGS. 8 and 12). The latching members 52 are configured to mate with reciprocal passages 54 (see FIG. 5) formed in the front face of the housing 12 to allow the TPA 14 to move between its preset and fully engaged positions. The front wall 50 of the TPA includes terminal openings 56, which align the front openings 24 of the terminal passages 20 when the TPA 14 is at its fully engaged position. Each latching member 52 includes first and second longitudinally extending legs 55, 57. (See FIG. 8). The distal ends of the legs 55, 57 are connected to each other by a lateral cross member 59. While two latching members 52 have been illustrated, it will be understood that one or more latching members may be provided, depending on the needs of the connector application. Similarly, it will be understood that actual configuration of the latching members 52 may take numerous other forms without departing from the scope of the present invention.

The latching members 52 present latching features configured to mate with reciprocal latching features in the housing for securing the TPA at is partially and fully engaged positions. In the illustrated embodiment, the latching features include first and second latching fingers 58, 60 formed on each of the latching members 52. The latching fingers 58, 60 extend from opposite sides of a respective latching member 52 and are positioned to engage with flanges or ribs formed in the passages 54. Specifically, as can be seen in FIGS. 12 and 13, each passage includes an outer rib 62 and an inner rib 64. In the illustrated embodiment, each passage 54 has one outer rib 62 and one inner rib 64. It will be appreciated that other configurations could be employed. For example, each passage could include a pair of opposed outer ribs and a pair of opposed inner ribs. The TPA 14 is secured to the housing by inserting the latching members 52 into the outer ends of the passages 54. As the latching members 52 slide into the passages 54, the first latching fingers 58 engage against the outer ribs 62. As the latching members 52 slide further into the passages 54, the latching fingers 58 move past the outer ribs 62, thereby securing the TPA 14 at is preset position. The opposed faces of the latching fingers 58 and/or the first ribs 62 may be beveled, as shown, to ease insertion of the latching fingers 58 past the ribs 62. The longitudinal gap 68 between the legs 55, 57 allows the first leg 55 to flex inwardly as the latching finger 58 moves past the outer rib 62.

When the TPA 14 is at its partially engaged position, the terminals 22 may be inserted into the passages 20, as was explained above. Once the terminals 22 are installed into the housing 12, the TPA 14 is slid towards its fully engaged position. As the TPA 14 moves towards its fully engaged position, the second latching fingers 60 engage against the inner ribs 64 in the passages 22. As the TPA 14 continues to move onto the housing 12, the latching fingers 60 slide past the inner ribs 64, thereby securing the TPA at is fully engaged position. Again, the longitudinal gap 68 allows the legs 55, 57 to flex inwardly as the latching fingers 58, 60 move past the inner ribs 64, 66. The faces of the latching fingers 58, 60 and/or the inner ribs 64, 66 may be beveled to ease insertion of the latching fingers past the ribs.

As can be seen in FIGS. 4 and 10, for example, the front end of the terminal latch 30 can be accessed through the front opening 24 of a respective terminal passage 20. A tool, such as a pick, can be inserted through the front opening and used to bias the terminal latch 30 outwardly so that the terminal 22 can be removed from the passage 20. Preferably the terminal is only removed in this manner when the TPA 14 is at its preset position. With the TPA 14 at its preset position, the distal end 72 of the wedge member 70 will limit outward travel of the terminal latch 30, thereby preventing the latch 30 from being overstressed during removal of the terminal 22 from the passage.

Referring to FIGS. 8–11, the TPA 14 includes overstress features that cooperate with the terminal latches 30 when the TPA 14 is at its preset position. The overstress features are configured to prevent the latches 30 from deflecting beyond a predetermined point as the terminals 22 are inserted into the passages 20. In the illustrated embodiment, the overstress features are in the form of wedge members 70 that are configured for insertion into the housing 12 at locations adjacent to the terminal latches 30. Each wedge member 70 is configured to serve as an overstress feature for two of the latches 30. It will be appreciated, however, that separate wedge members could be provided for each of the latches.

In operation, the wedge member 70 is inserted into the longitudinal gap 40 between adjacent latches 30. The wedge member includes reduced size distal portion 72 that extends between the distal ends of the associated latches 30 when the TPA 14 is at is preset position. (See FIG. 9). The distal portion 72 is sized to permit the terminal latches 30 to flex outwardly in their respective passages 20 a sufficient distance to allow the terminals 22 to be inserted into the passage 20. In this position, the distal portions 72 of the wedge members 70 also function as overstress mechanisms to prevent the latches 30 from flexing beyond a predetermined point, thereby preventing overstressing of the latch which could cause the latch to break.

Each wedge member 70 also includes an increased size proximal portion 74. As the TPA 14 is moved from its preset position to its fully engaged position, the wedge member 70 moves inwardly in the gap 40. As this occurs, the proximal portion 74 of the wedge member 70 engages against the latches 30, biasing the latches inwardly in their respective passages 20 so as to lock the terminals 22 in the passages 20.

The TPA 14 may also include one or more positioning members 76 (see FIG. 8) extending from the front wall 50. The positioning members 76 mate with reciprocal openings 78 (see FIG. 5) in the front face of the housing 12, and helps to properly align the TPA 14 with the housing 12.

The housing 12 may also include a plurality of other terminals (not shown) supported in respective terminal passages 80. (See FIG. 5). These passages 80 include latches 81 configured to lock the terminals into the housing in a manner as is well known in the art. The TPA 14 includes additional wedge members 82 (see FIG. 8) that are configured to engage against the latches 81 when the TPA 14 is moved to its fully engaged position, thereby locking the terminals into the housing.

Figure 14:
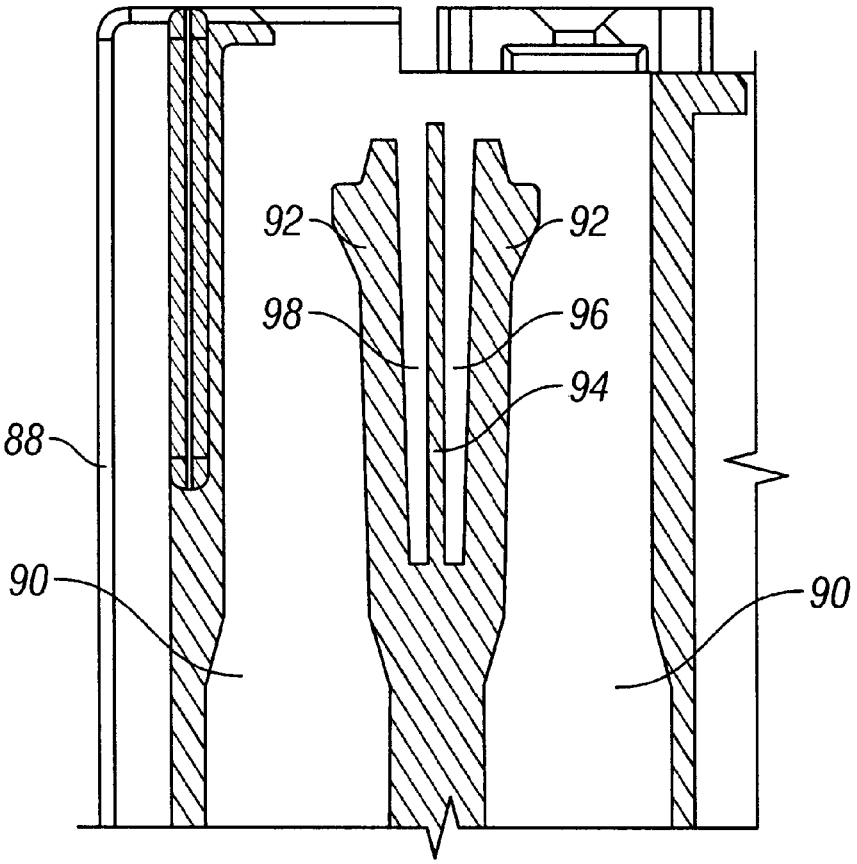
FIG. 14 (Prior Art)
FIG. 14 is a cross-section view of a prior art connector assembly.

FIG. 14 shows certain aspects of a prior art connector housing 88. The housing 88 of the connector has terminal passages carrying respective terminal latches 92. Adjacent terminal latches 92 are separated by a gap. An overstress wall 94 extends vertically in the gap, dividing the gap into first and second wedge receiving gaps 96, 98. In operation, wedge members from a TPA are inserted into the gaps 96, 98 to bias the latches 92 inwardly in the respective passages 90, so as to lock terminals (not shown) into the passages. The overstress wall 94 is provided to prevent the terminal latches 92 from overstressing, e.g., from flexing outwardly too far as the terminals are inserted into and/or removed from the passages 90. A connector constructed according to certain aspects of the present invention provides a substantial space reduction in comparison with this prior connector design. For example, if each of the wedge receiving gaps 96, 98 are 2.2 mm wide and the overstress wall 94 is 1.6 mm wide, the total distance between the adjacent latches 92 would be 6.0 mm. By contrast, when the overstress feature is incorporated into the TPA as described above, this distance can be reduced to 2.2 mm, which corresponds to the width of a single wedge-receiving gap. Hence, by incorporating the overstress feature into the TPA it is possible to reduce the size of the connector when compared to the prior art connector.

While the invention has been described with reference to a specific embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical connector assembly comprising:

a housing having a plurality of terminal passages, each terminal passage having an opening configured to permit an electrical terminal to be inserted into the passage and a deflectable latch for securing the terminal within the passage;

a terminal position assurance device (TPA) matable with the housing for movement between a preset position and a fully engaged position, the TPA defining overstress features which cooperate with the latches when the TPA is at its preset position to prevent the latches from deflecting beyond a predetermined point as the terminals are inserted into or removed from the passages;

wherein the overstress feature comprises wedge members that are insertable into the housing at locations adjacent the latches;

wherein each wedge member is configured to serve as an overstress feature for two of the latches.

2. An electrical connector as set forth in claim 1, wherein each wedge member has a reduced sized distal portion configured to underlie an associate latch when the TPA is at is preset position so as to prevent the latch from flexing beyond a predetermined point as the terminal is inserted into or removed from the passage.

3. An electrical connector as set forth in claim 2, wherein each wedge member has an increased size proximal portion configured to bias an associated latch inwardly in a respective passage when the TPA is moved to its fully engaged position.

4. An electrical connector as set forth in claim 1, wherein the TPA further comprises at least one latching member configured to mate with a reciprocal latching feature formed on the housing.

5. An electrical connector as set forth in claim 4, wherein the latching feature of the housing comprises a passage formed in the housing for receiving the latching member, the latching member including latching fingers positioned to mate with flanges formed in the passage.

6. An electrical connector as set forth in claim 1, wherein the housing includes front openings that provide access to the latches so the latches can be biased outwardly in the passages to permit the terminals to be removed from the passages.

7. An electrical connector assembly comprising:

a housing having a pair of adjacent terminal passages, each terminal passage having a rear opening configured to permit an electrical terminal to be inserted into the passage, each terminal passage including a deflectable latch for securing the terminal within the passage, the housing including a longitudinal gap that extends between the latches and permits the latches to deflect outwardly in their respective passage so that electrical terminals can be inserted into and removed from the passages;

a terminal position assurance device (TPA) matable with the housing for movement between a preset position and a fully engaged position, the TPA including a wedge member having a portion which mates with the longitudinal gap when the TPA is at its preset position to limit the deflection of the latches as the terminals are inserted into or removed from the passages.

8. An electrical connector as set forth in claim 7, wherein the wedge has an increased size proximal portion configured to bias the latches inwardly in a respective passage when the TPA is moved to its fully engaged position.

9. An electrical connector as set forth in claim 7, wherein the TPA further comprises at least one latching member configured to mate with a reciprocal latching feature formed on the housing.

10. An electrical connector as set forth in claim 9, wherein the latching feature of the housing comprises a passage formed in the housing for receiving the latching member, the latching member including latching fingers positioned to mate with flanges formed in the passage.

11. An electrical connector as set forth in claim 7, wherein the housing includes front openings that provide access to the latches so the latches can be biased outwardly in the passages to permit the terminals to be removed from the passages.

12. An electrical connector as set forth in claim 7, wherein the deflectable latches are integrally formed with one another.

13. A method for constructing an electrical connector assembly, comprising the steps of:

providing a housing having a pair of adjacent terminal passages, each terminal passage having a rear opening configured to permit an electrical terminal to be inserted into the passage, providing each terminal passage with a deflectable latch for securing the terminal within the passage, providing a longitudinal gap between the latches which is configured to permit the latches to deflect outwardly in the passages so that electrical terminals can be inserted into the passages;

providing a terminal position assurance device (TPA) matable with the housing for movement between a partially engaged position and a fully engaged position; and providing a wedge member on the TPA which includes a portion that mates with the longitudinal gap when the TPA is at its partially engaged position to limit the deflection of the latches as the terminals are inserted into or removed from the passages.

14. A method as set forth in claim 13, further comprising the step of providing the wedge with an increased size proximal portion configured to bias the latches inwardly in a respective passage when the TPA is moved to its fully engaged position.

* * * * *